United States Patent [19]

Lee

[11] 4,091,909

[45] May 30, 1978

[54] WIRE MATRIX PRINTER PRINTHEAD ASSEMBLY

[75] Inventor: Gene DuPree Lee, Dallas, Tex.

[73] Assignee: Texas Instruments Incorporated, Dallas, Tex.

[21] Appl. No.: 720,876

[22] Filed: Sep. 7, 1976

Related U.S. Application Data

[63] Continuation of Ser. No. 555,509, Mar. 5, 1975, abandoned.

[51] Int. Cl.[2] ..... B41J 3/04

[52] U.S. Cl. ..... 400/124; 101/93.05

[58] Field of Search ..... 197/1 R; 101/93.05

[56] References Cited

U.S. PATENT DOCUMENTS

| | | | |
|---|---|---|---|
| 3,584,575 | 6/1971 | Distl | 197/1 R X |
| 3,592,311 | 7/1971 | Chou et al. | 101/93.05 X |
| 3,672,482 | 6/1972 | Brumbaugh et al. | 197/1 R |
| 3,795,298 | 3/1974 | Kodis | 197/1 R |
| 3,897,865 | 8/1975 | Darwin et al. | 197/1 R |
| 4,400,671 | 1/1977 | Kondur, Jr. | 197/1 R |

*Primary Examiner*—Ralph T. Rader

*Attorney, Agent, or Firm*—Rene' E. Grossman; James T. Comfort; Thomas G. Devine

[57] ABSTRACT

A wire matrix printer mechanism is designed to print a series of alpha-numeric characters and symbols by mechanically impacting an inked ribbon with a column of small diameter steel wires, driving the ribbon into paper riding on a platen. The body through which the print members pass is a molded structure having a separate channel for each print member. Each channel has a path consistent with the elastic curvature of the corresponding print member to provide a path of least resistance.

8 Claims, 7 Drawing Figures

1Fig. 2A

WIRE MATRIX PRINTER PRINTHEAD ASSEMBLY

This is a continuation, of application Ser. No. 555,509, filed Mar. 5, 1975, now abandoned.

BACKGROUND OF THE INVENTION

In matrix printing, the wire matrix employed in forming each alpha-numeric character is defined by a predetermined number of impressions arranged in a column which may be vertical or inclined and which are advanced to a predetermined number of laterally spaced positions. For example, a 5 × 7 matrix is comprised of seven print members each capable of printing a dot in the column in each of five parallel columns, thereby forming a legible, alpha-numeric character.

In the past, providing channels for the print members having low resistance paths has been difficult because of the technique used in forming a low resistance path during the fabrication of the body containing the channels. A typical method of forming the body is to insert each of the print elements into a flexible tube and to support both ends of the wire as desired, that is, at the activation end and at the impression end. The wire then takes a natural, flexed position so that a potting compound can then be used to form the body and to fix the flexible tubes into the positions of paths that are of least resistance. The problem with this form of structure is that fabrication is a difficult assembly process and the handling of the mechanism during fabrication tends to upset the curvature of the path, thereby resulting in a path with too much resistance.

This invention permits the manufacture of a printhead body by a simple molding process, such as injection molding. The printhead body may be formed of a moldable or castable material, such as, for example, thermoplastic or thermal setting material. The mold contains the impressions of the channels, the impressions having been formed in accordance with equations mathematically setting out the paths of least resistance.

BRIEF SUMMARY OF THE INVENTION

A wire matrix printer mechanism has a printhead carriage assembly with a molded body structure. A plurality of solenoids are mounted on the body structure and attached to respective activation ends of a like number of print members. When selectively activated, the solenoids drive the respective print members through corresponding print member channels in the body structure, driving the impression ends of the print members into contact with a printing medium such as an inked ribbon which in turn contacts paper which is driven over a platen. Impression ends of the drive members pass through a like number of bearings arranged in a column which can be vertical or inclined, depending upon the style of character desired.

The body structure has, as an integral feature, the print member channels formed therein. The channels are curved and positioned in accordance with coordinates expressed through a mathematical derivation to provide the paths of least resistance for each of the drive members.

It is therefore a principal object of this invention to provide a body for a matrix printer printhead that has integrally formed print member channels, the channels providing paths of least resistance for each of the print members.

Another object of this invention is to provide a body structure for the printhead of a wire matrix printer that is capable of being fabricated in a molding process.

Still another object of this invention is to provide a body structure for the printhead of a wire matrix printer that can be formed of a thermoplastic material.

It is a further object of this invention to provide a body for the printhead of a wire matrix printer that contains no tubing or sleeves.

These and other objects will be made evident in the detailed description that follows.

BRIEF DESCRIPTION ON THE DRAWINGS

FIG. 2A is a perspective view of the upper section of the body assembly.

DETAILED DESCRIPTION OF THE INVENTION

Figure 1:
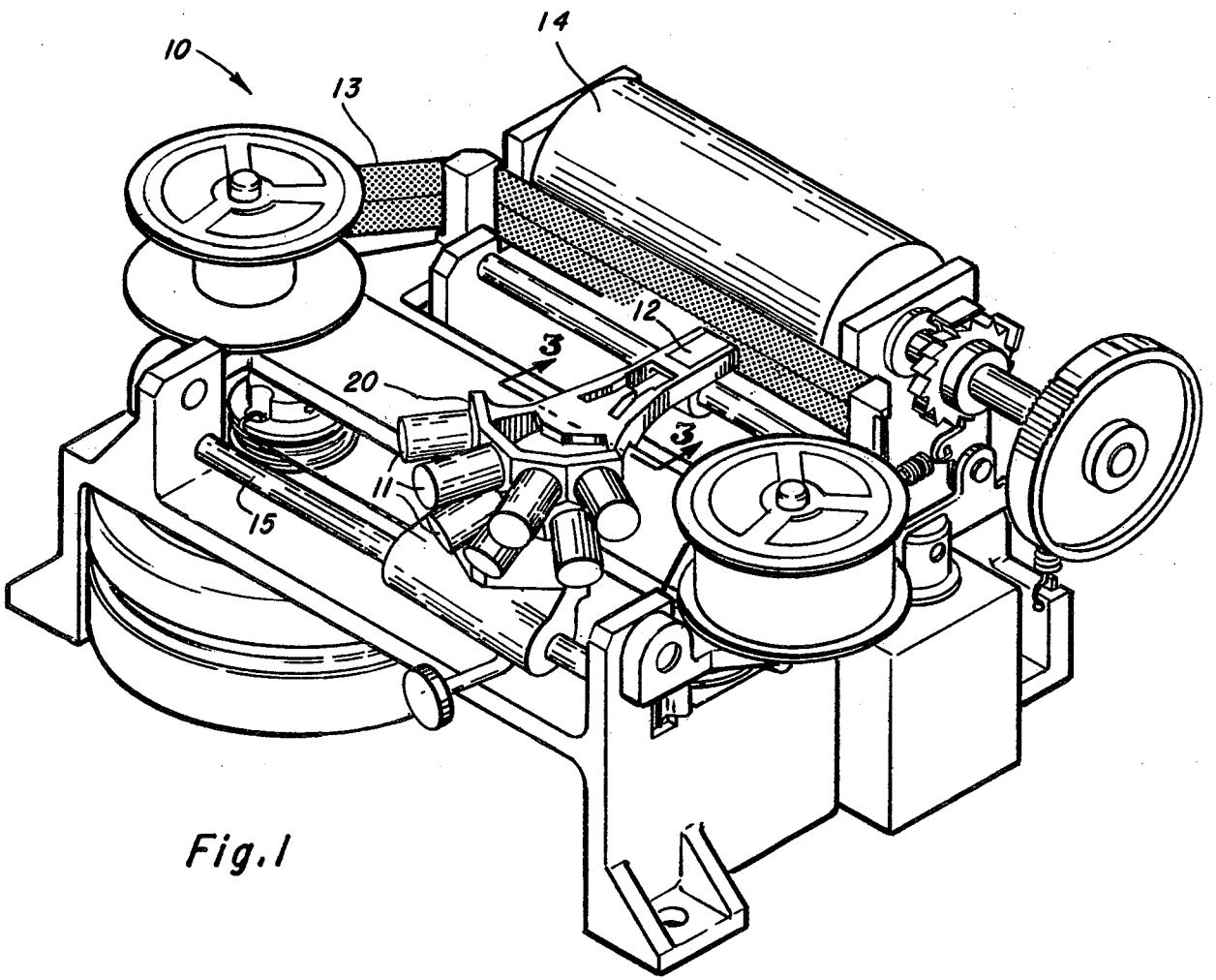
FIG. 1 is a perspective drawing of the wire matrix printer, illustrating the printhead carriage assembly in position thereon.

FIG. 1 illustrates a wire matrix printer 10 with the printhead assembly 20 shown in printing position. Driving solenoids 11 are shown mounted on the printhead 20 with front bearing array 12 shown at the front end of the printhead assembly. The print members (not shown) are driven by the solenoids 11 and pass through the front bearing array 12 to impact an inked ribbon 13 against a sheet of paper (not shown) which bears against the platen 14. The printhead assembly 20 moves along guide shafts 15 and 16.

Figure 2B:
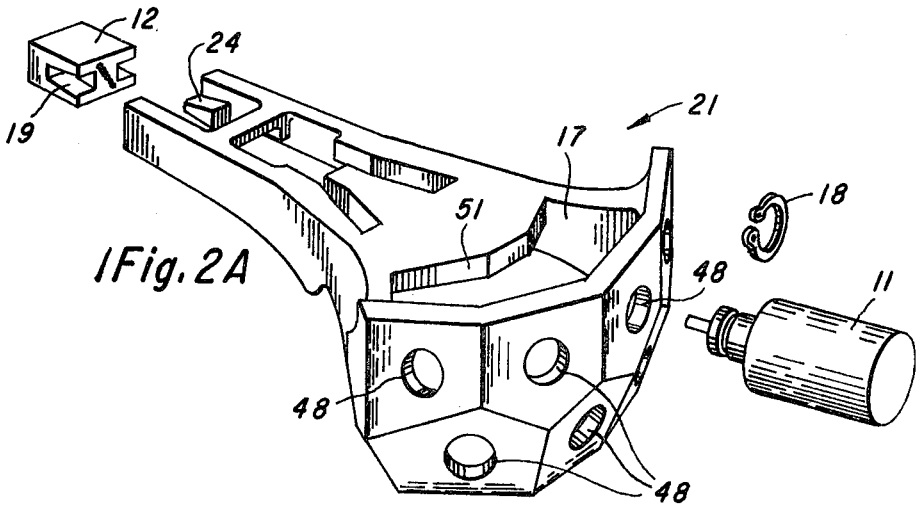
FIG. 2B is a perspective view of the center section of the body assembly.
Figure 2B:
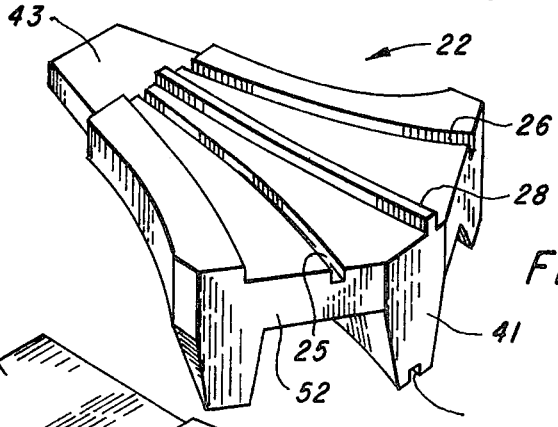

FIG. 2A illustrates, in perspective, the top section 21 of the printhead assembly 20, with solenoid 11 and its retaining lock 18 shown in an exploded view to illustrate the mounting in the appropriate aperture 48. The front bearing assembly 12 is also shown in an exploded view, having grooves 19 to fit over tabs 24 of the top section 21. Print member entry 49 is shown in front bearing array 12 which, in the preferred embodiment, receives a total of 7 print members which pass through the front bearing array 12 in a final pattern of a 7 dot column (not shown). Aperture 17 has a surface 51 which roughly aligns with surface 52 of the center section 22 shown in FIG. 2B.

FIG. 2B illustrates tongue 28 which fits into a groove (not shown) of the top section 21. Print member channels 25 and 26 are shown, with the solenoid end of grooves partially forming print member channel 27 shown. Extension 43 of center section 22 is shown at a level below that of the bottom of channels 25 and 26 defining a free space through which print members 34 and 36 respectively (FIG. 3) must pass. Also, in the space between surface 52 of center section 22 and the driving end of solenoid 11, there is a free space through which print members 34 and 36 must travel.

Figure 2C:
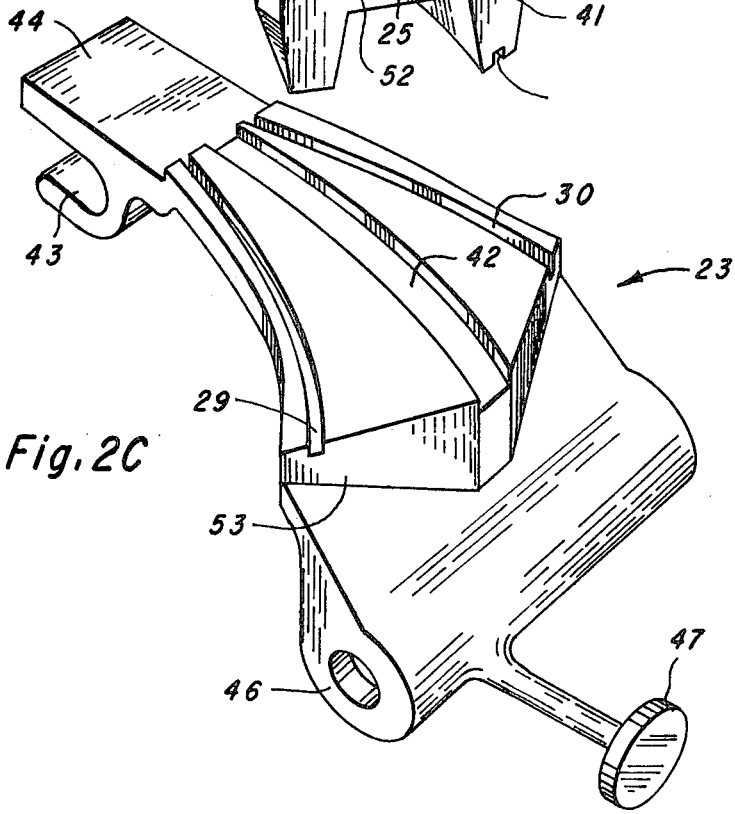
FIG. 2C is a perspective view of the lower section of the body assembly.

Lower section 23, as shown in FIG. 2C, has a groove 42 into which tongue 41 of center section 22 fits. Rear mount 46 travels on guide shaft 15 as shown in FIG. 1 and front mount 45 travels on guide shaft 16 shown in FIG. 1. Strain relief 47 is a member integral with the front mount 46 through which connecting wires pass.

Figure 3:
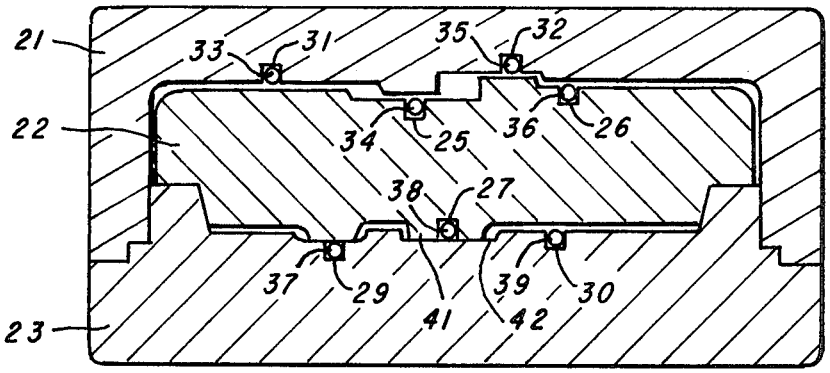
FIG. 3 is a section taken on 3—3 of FIG. 1.

Grooves partially forming print member channels 29 and 30 are formed in the lower section 23 and terminates at the front end at projection 44 which is at a level lower than the bottom of either of print channels 29 or 30 and defines a free space through which print members 37 and 39 of FIG. 3 must pass. The distance defined by the space between surface 53 and the respective solenoids 11 define a free space at the rear through which print members 37 and 39 must pass.

FIG. 3, a cross section taken at 3—3 of FIG. 1, shows the upper section 21, center section 22 and lower section 23 of the printhead. Formed in upper section 21 are grooves partially forming print member channels 31 and 32 which are not shown in FIG. 2A. Print members 33 and 35 travel through print member channels 31 and 32 respectively and also have free space to traverse at the front and rear as mentioned for other print members. Center section 22 is shown with print member channels 25, 26, and 27 containing print members 34, 36 and 38 respectively.

Lower section 23 is shown with grooves partially forming print member channels 29 and 30 containing print members 37 and 39 respectively.

In this preferred embodiment, seven print members are illustrated, but more or less could be incorporated in a single column, or in a plurality of columns at the impression end.

Figure 4:
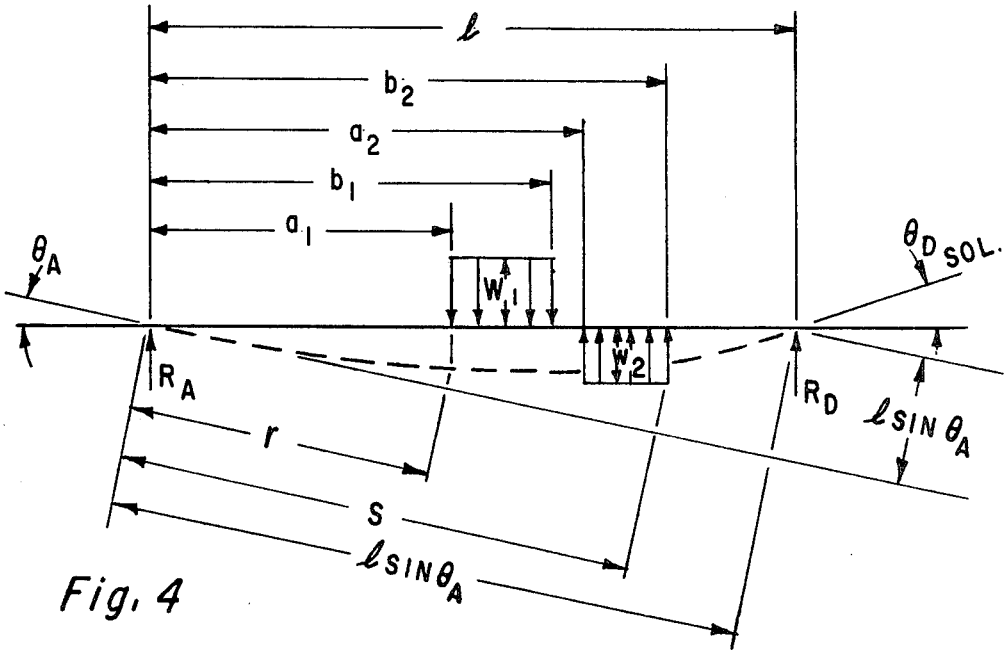
FIG. 4 illustrates diagramatic loading of a beam to determine the paths of the channels through the body assembly.

Referring now to FIG. 4, variable and fixed parameters used in the equations to determine the least resistant paths for the print members are diagramatically shown. Each print member is treated as a simply supported beam and not a cantilever. In FIG. 4, the impression end of a print member is shown at $R_A$ and the activation end is shown at $R_D$. The loading through the body member is shown as $w_1$ and $w_2$. The rotational deflection angles are shown as $\theta_A$ at the impression end and $\theta_D$ at the activation end. The angle $\beta$ is not shown directly, but is an arbitrary angle chosen for a given solenoid 11 to make with the center line of the printhead body 20. Angle $\beta$ is chosen as a matter of mechanical convenience wherein:

$$\beta = \theta_A + \theta_D$$

$w_1$ and $w_2$ represent loading within the print member channels, with the absolute amplitudes being made identical as part of the equation solving process. Consider the following two equations:

$$\theta = 1/6EI(A_1 W_1 - A_2 W_2) \quad (1)$$

$$\theta = 1/6EI(D_1 W_1 - D_2 W_2) \quad (2)$$

Equations 1 and 2 are solved so that the absolute magnitude of $w_1$ is the same as that of $w_2$. Where:

$$A_1 = 1/L\{d_1(d_1^2 - L^2) + c_1^2/4(L + c_1/2 - b_1)\}$$

$$A_2 = 1/L\{d_2(d_2^2 - L^2) + c_2^2/4(L + c_2/2 - b_2)\}$$

$$D_1 = 1/L\{c_1^2/4(c_1/2 - b_1) + d_1(d_1^2 - 3d_1 L + 2L^2)\}$$

$$D_2 = 1/L\{c_2^2/4(c_2/2 - b_2) + d_2(d_2^2 - 3d_2 L + 2L^2)\}$$

$$d_1 = L - (a_1 + b_1)/2$$

$$d_2 = L - (a_2 + b_2)/2$$

$$c_1 = b_1 - a_1$$

$$c_2 = b_2 - a_2$$

$$W_1 = w_1 c_1$$

$$W_2 = w_2 c_2$$

Solving for $W_1$ and $W_2$:

$$W_1 = 6EI/c_1 (A_2\theta_D - D_2\theta_A)/(D_1A_2 - D_2A_1) \quad (3)$$

$$W_2 = 6EI/c_2 (A_1\theta_D - D_1\theta_A)/(D_1A_2 - D_2A_1) \quad (4)$$

Fixed Parameters:
$L$ = wire length
$E$ = wire material modulus of elasticity
$I$ = wire inertia
$a_1$ = start of wire load
$b_2$ = end of wire load
$\theta_A$ = rotation at end A
$\theta_D$ = rotation at end D
Variable Parameters:
$a_2$ = start of load $w_2$
$b_1$ = end of load $w_1$
generally $a_2 - b_1 \geqq 0.050$ inches.

When $w_1$ and $w_2$ are established, the reactions are:

$$R_A = w_1 d_1/L + w_2 d_2/L$$

$$R_D = w_1/L(a_1 + c_1/2) + w_2/L(a_2 + c_2/2)$$

Figure 5:
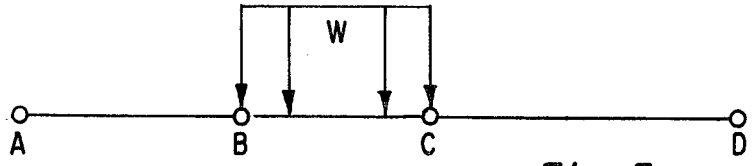
FIG. 5 is a simplified diagram illustrating beam loading.

Referring now to FIG. 5, W is shown as the absolute sum of the magnitudes of $w_1$ and $w_2$. The difference between points A and B represents the distance between the impression end of the print member and the entry into the corresponding print member channel. The distance from B to C represents the distance of the print member channel. Finally, the distance between C and D represents the distance that the print member travels from the print member channel to the solenoid. The dimensions measured from A to D are in the X direction and the following equations define the curve Y of the print member in terms of coordinate X and other dimensions already defined:

5. Dimension (A—B)

$$y = 1/48EI\{8R_A(x^3 - L^2x) + Wx(8d^3/L - 2bc^2/L + C^3/L + 2c^2\}$$

6. Dimension (B—C)

$$y = 1/48EI\{8R_A(x^3 - L^2x) + Wx(8d^3/L - 2bc^2/L + c^3/L + 2c^2) - 2W(x-a)^4/c\}$$

7. Dimension (C—D)

$$y = 1/48EI\{8R_A(x^3 - L^2x) + Wx(8d^3/L - 2bc^2/L + \lambda c^3/L) - 8W(x - a/2 - b/2)^3 + W(2bc^2 - c^3)\}$$

The equation of particular concern with respect to the print member channel is equation 6 which, of course, defines that path within the printhead body itself.

Having calculated the coordinates of the curves, the coordinates are transposed into a plane intersecting the solenoid corresponding to the particular print member and the bearing array. A representative set of values of constants and variables follow:

| | CURVE | | | | | | |
|---|---|---|---|---|---|---|---|
| | 1 | 2 | 3 | 4 | 5 | 6 | 7 |
| $a_1$ | 1.0050 | .9875 | .9875 | 1.0050 | .9875 | .9875 | 1.0000 |
| $b_1$ | 1.5213 | 1.4497 | 1.4697 | 1.4658 | 1.4806 | 1.474 | 1.4940 |
| $a_2$ | 1.6563 | 1.5847 | 1.6047 | 1.6008 | 1.6156 | 1.6090 | 1.6290 |
| $b_2$ | 1.8270 | 1.7150 | 1.7120 | 1.8200 | 1.7500 | 1.7500 | 1.9000 |
| r | 1.0075 | 1.0073 | 1.0071 | 1.0076 | 1.0072 | 1.0071 | 1.0077 |
| s | 1.8191 | 1.6547 | 1.6538 | 1.8115 | 1.6853 | 1.6844 | 1.8698 |
| L | 2.07245 | 1.983174 | 1.980661 | 2.073327 | 1.981485 | 1.977123 | 2.064673 |
| $L \sin \theta_A$ | .2268 | .6343 | .6264 | .2347 | .6290 | .6290 | .4028 |
| $L \cos \theta_A$ | 2.060 | 1.8790 | 1.8790 | 2.060 | 1.8790 | 1.8744 | 2.025 |
| $\theta^\circ_A$ | 6.2828 | 18.6533 | 18.4368 | 6.4998 | 18.5081 | 18.5504 | 11.2501 |
| $\theta^\circ_D$ | 6.7172 | 20.3467 | 20.5632 | 6.5002 | 20.4919 | 20.4496 | 11.2499 |
| $R_A$ | .00925 | .02966 | .02910 | .00984 | .02924 | .02947 | .01707 |
| $R_D$ | .00908 | .03331 | .03678 | .00624 | .03405 | .03320 | .00724 |
| $W_1$ | .05305 | .18977 | .17571 | .06652 | .1764 | .1814 | .1093 |
| $W_2$ | .05305 | .18988 | .17563 | .06653 | .1762 | .1816 | .109 |

PREFERRED MODE OF OPERATION

In operation, a 5×7 matrix to form an alpha numeric-character is used. By electrically selecting solenoid 11, a desired number of dots is impressed on paper to the inked ribbon and then the printhead is moved to a second column position where again selected solenoids cause the impression ends of the print members to print dots in a second column. This procedure is repeated for five rows, thereby forming the desired alpha-numeric character. In this preferred embodiment, the column of 7 dots is inclined slightly from the vertical to produce a desired type font. The column could, of course, be perfectly vertical and more than one column could be used, without departing from the spirit and scope of this invention.

What is claimed is:

1. In a matrix printer mechanism having a printhead-carriage assembly and a print medium, the printhead comprising:

(a) a plurality of print members, each having an impression end and an activation end;

(b) a front bearing array through which the impression ends pass, disposed in confronting relation to the print medium;

(c) drive means operatively connected to the activation ends to selectively drive the impression ends into contact with the print medium; and (d) a body assembly, terminating at one end in the front bearing array and mounting the drive means at the opposite end, having integral therewith a plurality of print member channels communicating with the front bearing array and the drive means, each channel containing one print member and each having a path consistent with the elastic curvature of the member contained therein, the body assembly comprising an upper section having a generally flat lower surface, a center section having generally flat upper and lower surfaces, and a lower section having a generally flat upper surface, the print member channels being formed as grooves in the respective flat surfaces with the non-grooved portions of the flat surfaces completely enclosing the grooves to form the print member channels.

2. The printhead of claim 1 wherein the drive means include means for reversing the previously activated print members to move them away from the print medium.

3. The printhead of claim 2 wherein the body assembly is formed of a thermoplastic material.

4. The printhead of claim 2 wherein the body assembly is formed of a thermal setting material.

5. The printhead of claim 1 wherein the drive means comprise a plurality of solenoids, each attached to a respective print member to positively drive the print member forward.

6. The printhead of claim 3 wherein the drive means comprise a plurality of solenoids, each attached to a respective print member to positively drive the print member forward.

7. The printhead of claim 3 wherein there are seven print members and channels therefor, and the front bearing array is arranged in a column of seven bearings through which the impression ends pass.

8. The printhead of claim 5 wherein there are seven print members and channels therefor, and the front bearing array is arranged in a column of seven bearings through which the impression ends pass.

* * * * *